US006143712A

United States Patent [19]

Beckers et al.

[11] Patent Number: 6,143,712

[45] Date of Patent: Nov. 7, 2000

[54] FABRIC SOFTENING COMPOSITIONS

[75] Inventors: Martine Irene Maria Beckers, Overpelt; Axel Masschelein, Brussels, both of Belgium

[73] Assignee: The Proctor & Gamble Company, Cincinnati, Ohio

[21] Appl. No.: 09/269,085

[22] PCT Filed: Sep. 10, 1997

[86] PCT No.: PCT/US97/16379

§ 371 Date: Mar. 18, 1999

§ 102(e) Date: Mar. 18, 1999

[87] PCT Pub. No.: WO98/12289

PCT Pub. Date: Mar. 26, 1998

[30] Foreign Application Priority Data

| | | | |
|---|---|---|---|
| Sep. 19, 1996 | [EP] | European Pat. Off. | 96870119 |
| May 16, 1997 | [EP] | European Pat. Off. | 97201491 |

[51] Int. Cl.[7] ..... C11D 3/37; C11D 1/62

[52] U.S. Cl. ..... 510/517; 510/524

[58] Field of Search ..... 510/475, 517, 510/524

[56] References Cited

U.S. PATENT DOCUMENTS

| | | | |
|---|---|---|---|
| 4,689,167 | 8/1987 | Collins et al. | 252/95 |
| 4,767,547 | 8/1988 | Straathof et al. | 252/8.8 |
| 5,565,145 | 10/1996 | Watson et al. | 510/350 |
| 5,643,865 | 7/1997 | Mermelstein et al. | 510/521 |
| 5,686,376 | 11/1997 | Rusche et al. | 502/329 |
| 5,830,843 | 11/1998 | Hartman et al. | 510/475 |
| 5,958,858 | 9/1999 | Bettiol et al. | 510/351 |

FOREIGN PATENT DOCUMENTS

| | | |
|---|---|---|
| 2075028 | 11/1981 | United Kingdom . |

*Primary Examiner*—Necholus Ogden
*Assistant Examiner*—John R. Hardee
*Attorney, Agent, or Firm*—Frank C. Turner; Jason J. Camp

[57] ABSTRACT

The present invention relates to a liquid fabric softening composition comprising a cationic biodegradable fabric softener and an alkoxylated amino-functional polymer, whereby said combination provides an increased color care benefit on treated fabrics but also enables the use of higher levels of polymers without being detrimental to the stability of the composition.

23 Claims, No Drawings

FABRIC SOFTENING COMPOSITIONS

FIELD OF THE INVENTION

The present invention relates to liquid fabric softening compositions which provide care to the colors of fabrics.

BACKGROUND OF THE INVENTION

The appearance of colored fabrics, e.g., clothing, bedding, household fabrics like table linens is one of the area of concern to consumers. Indeed, upon typical consumer's uses of the fabrics such as wearing, washing, rinsing and/or tumble-drying of fabrics, a loss in the fabric appearance; which is at least partly due to loss of color fidelity and color definition, is observed. Such a problem of color loss is even more acute after multiwash cycles.

It is therefore an object of the invention to provide a composition which provides improved color care to the laundered fabrics, especially after multiwash cycles.

The Applicant has now surprisingly found that the combination of a cationic biodegradable fabric softener and a specific alkoxylated amino-functional polymer in a liquid fabric softening composition overcomes the problem.

Another advantage of the composition of the invention is that said specific alkoxylated amino-functional polymers can be formulated at higher levels in fabric softening compositions, without being detrimental to the stability of the composition, thereby increasing the color care benefit. Indeed, it has been surprisingly found that, compared to non-alkoxylated amino-functional polymers, alkoxylated amino-functional polymers present at a level above 1% by weight of the fabric softening composition do not produce a storage instability of the resulting product.

EP 43,622 discloses fabric softening compositions comprising a water-insoluble cationic fabric softener and a polyethylene imine as part of a two-component viscosity regulator. One example is disclosing di(2-tallowylamido) ethyl methyl ammonium chloride) in combination with ethoxylated polyethylene imine having a molecular weight of 60.000. No other biodegradable fabric softeners are described. The compositions of the '622 are said to display viscosity control.

SUMMARY OF THE INVENTION

The present invention is a liquid fabric softening composition comprising a cationic biodegradable fabric softener and an alkoxylated amino-functional polymer, wherein said alkoxylated amino-functional polymer is a non-oxidised, non-quaternised alkoxylated polyalkylene imine; and with the proviso that when said biodegradable cationic fabric softener is di(2-tallowylamido)ethyl methyl ammonium chloride), said amino-functional polymer is not an ethoxylated polyethyleneimine having a weight ratio of polyethyleneimine to ethylene oxide of 1.3:1 and a molecular weight of 60.000.

In another aspect of the invention, there is provided a method for providing color care on treated fabrics which comprises the step of contacting said fabrics in the rinse cycle with an aqueous medium containing said liquid fabric softening composition.

DETAILED DESCRIPTION OF THE INVENTION

Cationic Biodegradable Fabric Softener

A cationic biodegradable fabric softener is an essential component for the purpose of the invention. Typical levels of said fabric softener components within the liquid fabric softening composition are from 1% to 80% by weight of the compositions. Depending on the composition execution which can be dilute with a preferred level of fabric softener components from 1% to 5%, or concentrated, with a preferred level of fabric softener components from 5% to 80%, more preferably 10% to 50%, most preferably 15% to 35% by weight of the composition.

Said materials and fabric softening compositions containing them are disclosed in numerous publications such as EP-A-0,040,562, and EP-A-0,239,910.

The quaternary ammonium compounds and amine precursors herein have the formula (I) or (II), below:

(I)

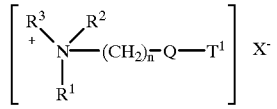

or (II)

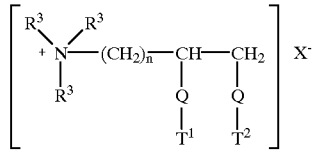

wherein

Q is selected from —O—C(O)—, —C(O)—O—, —O—C(O)—O—, —$NR^4$—C(O)—, —C(O)—$NR^4$—;

$R^1$ is $(CH_2)_n$—Q—$T^2$ or $T^3$;

$R^2$ is $(CH_2)_m$—Q—$T^4$ or $T^5$ or $R^3$;

$R^3$ is $C_1$–$C_4$ alkyl or $C_1$–$C_4$ hydroxyalkyl or H;

$R^4$ is H or $C_1$–$C_4$ alkyl or $C_1$–$C_4$ hydroxyalkyl;

$T^1$, $T^2$, $T^3$, $T^4$, $T^5$ are independently $C_{11}$–$C_{22}$ alkyl or alkenyl;

n and m are integers from 1 to 4; and $X^-$ is a softener-compatible anion.

Non-limiting examples of softener-compatible anions include chloride or methyl sulfate.

The alkyl, or alkenyl, chain $T^1$, $T^2$, $T^3$, $T^4$, $T^5$ must contain at least 11 carbon atoms, preferably at least 16 carbon atoms. The chain may be straight or branched.

Tallow is a convenient and inexpensive source of long chain alkyl and alkenyl material. The compounds wherein $T^1$, $T^2$, $T^3$, $T^4$, $T^5$ represent the mixture of long chain materials typical for tallow are particularly preferred.

Specific examples of quaternary ammonium compounds suitable for use in the aqueous fabric softening compositions herein include:

1) N,N-di(tallowyl-oxy-ethyl)-N,N-dimethyl ammonium chloride;
2) N,N-di(tallowyl-oxy-ethyl)-N-methyl, N-(2-hydroxyethyl)ammonium chloride;
3) N,N-di(2-tallowyl-oxy-2-oxo-ethyl)-N,N-dimethyl ammonium chloride;
4) N,N-di(2-tallowyl-oxy-ethylcarbonyl-oxy-ethyl)-N,N-dimethyl ammonium chloride;
5) N-(2-tallowyl-oxy-2-ethyl)-N-(2-tallowyl-oxy-2-oxo-ethyl)-N,N-dimethyl ammonium chloride;
6) N,N,N-tri(tallowyl-oxy-ethyl)-N-methyl ammonium chloride;

7) N-(2-tallowyl-oxy-2-oxo-ethyl)-N-(tallowyl-N,N-dimethyl-ammonium chloride;

8) N-methyl-N-(3-tallowamidopropyl),N-(2-tallowoyloxyethyl)ammonium chloride;

9) 1,2-ditallowyl-oxy-3-trimethylammoniopropane chloride;

and mixtures of any of the above materials.

Of these, compounds 1–8 are examples of compounds of Formula (I); compound 9 is a compound of Formula (II). Particularly preferred is N,N-di(tallowyl-oxy-ethyl)-N,N-dimethyl ammonium chloride, where the tallow chains are at least partially unsaturated. The level of unsaturation of the tallow chain can be measured by the Iodine Value (IV) of the corresponding fatty acid, which in the present case should preferably be in the range of from 5 to 100 with two categories of compounds being distinguished, having a IV below or above 25.

Indeed, for compounds of Formula (I) made from tallow fatty acids having a IV of from 5 to 25, preferably 15 to 20, it has been found that a cis/trans isomer weight ratio greater than 30/70, preferably greater than 50/50 and more preferably greater than 70/30 provides optimal concentrability. For compounds of Formula (I) made from tallow fatty acids having a IV of above 25, the ratio of cis to trans isomers has been found to be less critical unless very high concentrations are needed.

Other examples of suitable quaternary ammoniums of Formula (I) and (II) are obtained by, e.g.:

replacing "tallow" in the above compounds with, for example, coco, palm, lauryl, oleyl, ricinoleyl, stearyl, palmityl, or the like, said fatty acyl chains being either fully saturated, or preferably at least partly unsaturated;

replacing "methyl" in the above compounds with ethyl, ethoxy, propyl, propoxy, isopropyl, butyl, isobutyl or t-butyl;

replacing "chloride" in the above compounds with bromide, methylsulfate, formate, sulfate, nitrate, and the like.

In fact, the anion is merely present as a counterion of the positively charged quaternary ammonium compounds. The nature of the counterion is not critical at all to the practice of the present invention. The scope of this invention is not considered limited to any particular anion.

By "amine precursors thereof" is meant the secondary or tertiary amines corresponding to the above quaternary ammonium compounds, said amines being substantially protonated in the present compositions due to the pH values.

For the preceding biodegradable fabric softening agents, the pH of the compositions herein is an essential parameter of the present invention. Indeed, it influences the stability of the quaternary ammonium or amine precursors compounds, especially in prolonged storage conditions.

The pH, as defined in the present context, is measured in the neat compositions at 20° C. For optimum hydrolytic stability of these compositions, the neat pH, measured in the above-mentioned conditions, must be in the range of from 2.0 to 4.5. Preferably, where the liquid fabric softening compositions of the invention are in a diluted form, the pH of the neat composition is in the range of 2.0 to 3.0. The pH of these compositions herein can be regulated by the addition of a Bronsted acid.

Examples of suitable acids include the inorganic mineral acids, carboxylic acids, in particular the low molecular weight ($C_1$–$C_5$) carboxylic acids, and alkylsulfonic acids. Suitable inorganic acids include HCl, $H_2SO_4$, $HNO_3$ and $H_3PO_4$. Suitable organic acids include formic, acetic, citric, methylsulfonic and ethylsulfonic acid. Preferred acids are citric, hydrochloric, phosphoric, formic, methylsulfonic acid, and benzoic acids.

Alkoxylated Amino-functional Polymer

The other essential component of the invention is a non-oxidised, non-quaternised alkoxylated polyalkylene imine. Typically, the amino-functional polymers for use herein have a molecular weight between 200 and $10^6$, preferably between 600 and 20,000, most preferably between 1000 and 10,000.

Preferably, the amino-functional polymers of the present invention are selected from a)-linear or non-cyclic polyamines having a backbone of the formula:

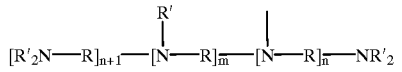

b)-cyclic polyamines having a backbone of the formula:

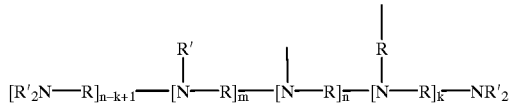

and mixtures thereof;

wherein in at least one of the polyamine backbone NR' units, R' is $$—(R^1O)_xB$$

and wherein the backbone linking R units are selected from the group consisting of $C_2$–$C_{12}$ alkylene, $C_4$–$C_{12}$ alkenylene, $C_3$–$C_{12}$ hydroxyalkylene, $C_4$–$C_{12}$ dihydroxy-alkylene, $C_8$–$C_{12}$ dialkylarylene, $—(R^1O)_xR^1—$, $—(R^1O)_xR^5(OR^1)_x—$, $(CH_2CH(OR^2)CH_2O)_z(R^1O)_yR^1(OCH_2CH(OR^2)CH_2)_w—$, $—C(O)(R^4)_rC(O)—$, $—CH_2CH(OR^2)CH_2—$, and mixtures thereof; wherein $R^1$ is selected from the group consisting of $C_2$–$C_6$ alkylene, $C_3$–$C_6$ alkyl substituted alkylene, and mixtures thereof; $R^2$ is selected from the group consisting of hydrogen, $—(R^1O)_xB$, and mixtures thereof; $R^4$ is selected from the group consisting of $C_1$–$C_{12}$ alkylene, $C_4$–$C_{12}$ alkenylene, $C_8$–$C_{12}$ arylalkylene, $C_6$–$C_{10}$ arylene, and mixtures thereof; $R^5$ is selected from the group consisting of $C_1$–$C_{12}$ alkylene, $C_3$–$C_{12}$ hydroxyalkylene, $C_4$–$C_{12}$ dihydroxy-alkylene, $C_8$–$C_{12}$ dialkylarylene, $—C(O)—$, $—C(O)NHR^6NHC(O)—$, $—R^1(OR^1)—$, $—C(O)(R^4)_rC(O)—$, $—CH_2CH(OH)CH_2—$, $—CH_2CH(OH)CH_2O(R^1O)_yR^1OCH_2CH(OH)CH_2—$, and mixtures thereof; $R^6$ is selected from the group consisting of $C_2$–$C_{12}$ alkylene or $C_6$–$C_{12}$ arylene; R' units are selected from the group consisting of hydrogen, $C_1$–$C_{22}$ alkyl, $C_3$–$C_{22}$ alkenyl, $C_7$–$C_{22}$ arylalkyl, $C_2$–$C_{22}$ hydroxyalkyl, $—(CH_2)_pCO_2M$, $—(CH_2)_qSO_3M$, $—CH(CH_2CO_2M)CO_2M$, $—(CH_2)_pPO_3$ , $M—(R^1O)_xB$, $—C(O)R^3$, and mixtures thereof; B is selected from the group consisting of hydrogen, $C_1$–$C_6$ alkyl, $—(CH_2)_qSO_3M$, $—(CH_2)_pCO_2M$, $—(CH_2)_q(CHSO_3M)CH_2SO_3M$, $—(CH_2)_q—(CHSO_2M)CH_2SO_3M$, $—(CH_2)_pPO_3M$, $—PO_3M$, and mixtures thereof; $R^3$ is selected from the group consisting of $C_1$–$C_{18}$ alkyl, $C_7$–$C_{12}$ arylalkyl, $C_7$–$C_{12}$ alkyl substituted aryl, $C_6$–$C_{12}$ aryl, and mixtures thereof; M is hydrogen or a water-soluble cation in sufficient amount to satisfy charge balance; X is a water-soluble anion; m has the value from 2 to about 700; n has the value from 0 to about 350; p has the value from 1 to 6, q has the value from 0 to 6; r has the value of 0 or 1; w has the value 0 or 1; x has the value from 1 to 100; y has the value from 0 to 100; z has the value 0 or 1.

Preferably x has a value lying in the range of from 1 to 20, preferably from 1 to 10.

Preferably, R is selected from the group consisting of $C_2$–$C_{12}$ alkylene, $C_3$–$C_{12}$ hydroxyalkylene, $C_4$–$C_{12}$ dihydroxyalkylene, $C_8$–$C_{12}$ dialkylarylene, —$(R^1O)_xR^1$—, —$(R^1O)_xR^5(OR^1)_x$—, —$(CH_2CH(OH)CH_2O)_z(R^1O)_yR^1$—$(OCH_2CH(OH)CH_2)_w$—, —$CH_2CH(OR^2)CH_2$—, and mixtures thereof, more preferably R is selected from the group consisting of $C_2$–$C_{12}$ alkylene, $C_3$–$C_{12}$ hydroxyalkylene, $C_4$–$C_{12}$ dihydroxyalkylene, —$(R^1O)_xR^1$—, —$(R^1O)_xR^5$—$(OR^1)_x$—, $(CH_2CH(OH)CH_2O)_z(R^1O)_yR^1(OCH_2CH(OH)CH_2)_w$—, and mixtures thereof, most preferably R is selected from the group consisting of $C_2$–$C_6$ alkylene, $C_3$ hydroxyalkylene and mixtures thereof. A most preferred R group is $C_2$–$C_6$ alkylene.

Preferably, $R^1$ is selected from the group consisting of $C_2$–$C_6$ alkylene, $C_3$–$C_6$ alkyl substituted alkylene, and mixtures thereof, more preferably $R^1$ is ethylene.

Preferably, $R^2$ is hydrogen.

Preferably, $R^3$ is selected from the group consisting of $C_1$–$C_{12}$ alkyl, $C_7$–$C_{12}$ alkylarylene, and mixtures thereof, more preferably $R^3$ is selected from the group consisting of $C_1$–$C_{12}$ alkyl and mixtures thereof, most preferably $R^3$ is selected from the group consisting of $C_1$–$C_6$ alkyl and mixtures thereof. A most preferred group for $R^3$ is methyl.

Preferably, $R^4$ is selected from the group consisting of $C_2$–$C_{12}$ alkylene, $C_8$–$C_{12}$ arylalkylene, and mixtures thereof, more preferably $R^4$ is selected from the group consisting of $C_2$–$C_6$, most preferably $R^4$ is ethylene or butylene.

Preferably $R^5$ is selected from the group consisting of ethylene, —C(O)—, —$C(O)NHR^6NHC(O)$—, —$R^1(OR^1)_y$—, —$(CH_2CH(OH)CH_2O)_z(R^1O)_yR^1$—$(OCH_2CH(OH)CH_2)_w$—, —$CH_2CH(OH)CH_2$—, and mixtures thereof, more preferably $R^5$ is —$CH_2CH(OH)CH_2$—.

Preferably R' units are selected from the group consisting of hydrogen, $C_3$–$C_{22}$ hydroxyalkyl, benzyl, $C_1$–$C_{22}$ alkyl, —$(R^1O)_xB$, —$C(O)R^3$, —$(CH_2)_pCO_2^-M^+$, —$(CH2)_qSO_3^-M^+$, —$(CH_2CO_2M)CO_2M$ and mixtures thereof, more preferably R' units are selected from the group consisting of hydrogen, $C_1$–$C_{22}$ alkyl, —$(R^1O)_xB$, —$C(O)R^3$, and mixtures thereof, most preferably R' units are —$(R^1O)_xB$.

Preferably B units are selected from the group consisting of hydrogen, $C_1$–$C_6$ alkyl, —$(CH_2)_qSO_3M$, —$(CH_2)_q(CHSO_3M)CH_2SO_3M$, —$(CH_2)_q(CHSO_2M)$—$CH_2SO_3M$, and mixtures thereof, more preferably B is selected from the group consisting of hydrogen, —$(CH_2)_qSO_3M$, —$(CH_2)_q(CHSO_3M)CH_2SO_3M$, —$(CH_2)_q(CHSO_2M)$—$CH_2SO_3M$, and mixtures thereof, most preferably B is selected from the group consisting of hydrogen, wherein q has the value from 0 to 3.

When no modification or substitution is made on a nitrogen then hydrogen atom will remain as the moiety representing R'.

Preferably the compounds of the present invention comprise polyamines having a ratio of m:n that is at least 1:1 but may include linear polymers (n equal to 0) as well as a range as high as 10:1, preferably the ratio is 2:1. When the ratio of m:n is 2:1, the ratio of primary:secondary:tertiary amine moieties, that is the ratio of —$RNH_2$, —RNH, and —RN moieties, is 1:2:1.

R units are preferably selected from the group consisting of ethylene, 1,2-propylene, 1,3-propylene, and mixtures thereof, more preferably ethylene. R units serve to connect the amine nitrogens of the backbone.

The preferred polyamines of the present invention comprise backbones wherein less than 50% of the R groups comprise more than 3 carbon atoms. The use of two and three carbon spacers as R moieties between nitrogen atoms in the backbone is advantageous for controlling the fabric appearance enhancement properties of the molecules. More preferred embodiments of the present invention comprise less than 25% moieties having more than 3 carbon atoms. Yet more preferred backbones comprise less than 10% moieties having more than 3 carbon atoms. Most preferred backbones comprise 100% ethylene moieties.

The amino-functional polymers of the present invention comprise homogeneous or non-homogeneous polyamine backbones, preferably homogeneous backbones. For the purpose of the present invention the term "homogeneous polyamine backbone" is defined as a polyamine backbone having R units that are the same (i.e., all ethylene). However, this sameness definition does not exclude polyamines that comprise other extraneous units comprising the polymer backbone that are present due to an artifact of the chosen method of chemical synthesis. For example, it is known to those skilled in the art that ethanolamine may be used as an "initiator" in the synthesis of polyethyleneimines, therefore a sample of polyethyleneimine that comprises one hydroxyethyl moiety resulting from the polymerization "initiator" would be considered to comprise a homogeneous polyamine backbone for the purposes of the present invention.

For the purposes of the present invention the term "non-homogeneous polymer backbone" refers to polyamine backbones that are a composite of one or more alkylene or substituted alkylene moieties, for example, ethylene and 1,2-propylene units taken together as R units.

Other polyamines that comprise the backbone of the compounds of the present invention are generally polyalkyleneimines (PAI's), preferably polyethyleneimines (PEI's). The PEI's which comprise the preferred backbones of the polyamines of the present invention can be prepared, for example, by polymerizing ethyleneimine in the presence of a catalyst such as carbon dioxide, sodium bisulfite, sulfuric acid, hydrogen peroxide, hydrochloric acid, acetic acid, etc. Specific methods for preparing PEI's are disclosed in U.S. Pat. No. 2,182,306, Ulrich et al., issued Dec. 5, 1939; U.S. Pat. No. 3,033,746, Mayle et al., issued May 8, 1962; U.S. Pat. No. 2,208,095, Esselmann et al., issued Jul. 16, 1940; U.S. Pat. No. 2,806,839, Crowther, issued Sep. 17, 1957; and U.S. Pat. No. 2,553,696, Wilson, issued May 21, 1951 (all herein incorporated by reference). In addition to the linear and branched PEI's, the present invention also includes the cyclic amines that are typically formed as artifacts of synthesis. The presence of these materials may be increased or decreased depending on the conditions chosen by the formulator.

An example of amino-functional polymer comprising a PEI backbone wherein n is 6 and m is 5 comprising a partial substitution of nitrogens by replacement of hydrogen with a hydroxyethyl unit, —$CH_2CH_2OH$, has the formula

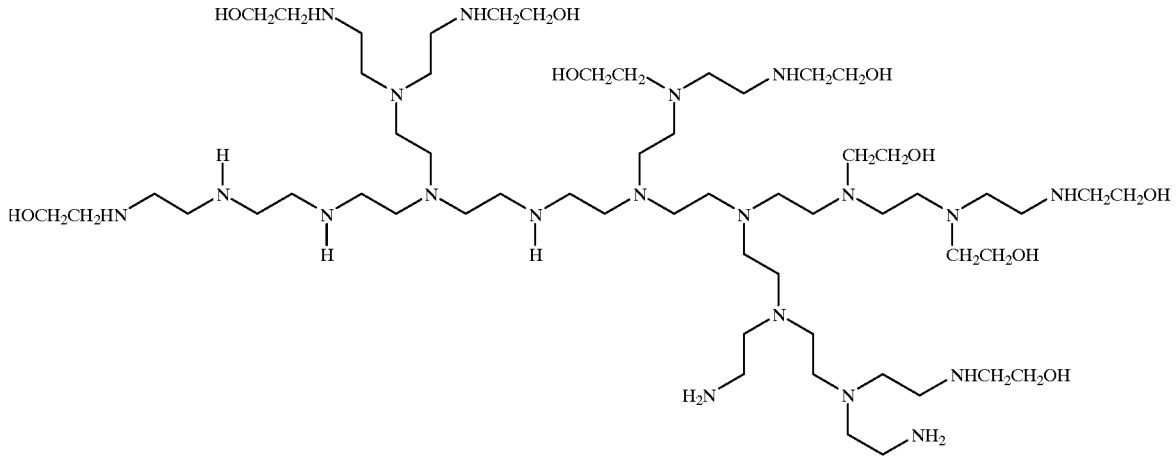

An example of amino-functional polymer comprising a PEI backbone wherein n is 6 and m is 5 and all substitutable nitrogens are modified by replacement of hydrogen with a hydroxyethyl unit, —$CH_2CH_2OH$, has the formula

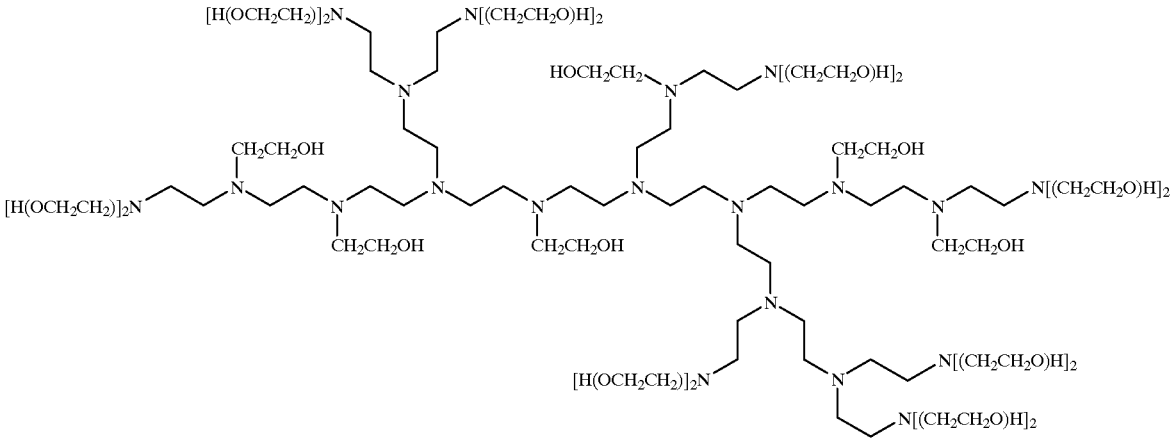

An example of amino-functional polymer comprising a PEI backbone wherein n is 6 and m is 5 and all substitutable nitrogens are modified by replacement of hydrogen with a polyoxyalkyleneoxy unit, —$(CH_2CH_2O)_7H$, has the formula

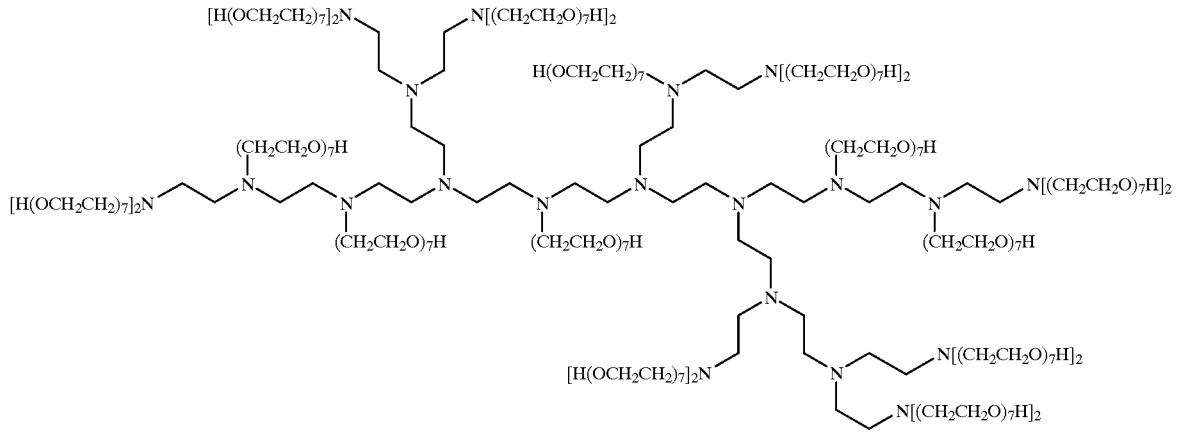

The polyamines of the present invention may develop undesirable off-colors due to impurities present as artifacts of their preparation or produced during processing or handling of the polyamines. In the case where the presence of color is unacceptable in the final formulation, the processor or formulator may apply one or more known procedures for "de-colorizing" the polyamines of the present invention. This de-colorizing may be accomplished at any stage in the processing of the polyamines disclosed herein, provided said processing does not limit or diminish the effectiveness of the final fabric appearance enhancement agents.

Commercially available alkoxylated amino-functional polymer suitable for use herein are hydroxyethylated poly (ethyleneimine) from Polysciences, with a MW2000, and 80% hydroxyethylated poly(ethyleneimine) from Aldrich.

A typical amount of amino-functional polymer to be employed in the composition of the invention is of at least 0.01% by weight, preferably of at least 1% by weight, more preferably of from 1% to 50% by weight of the composition, most preferably of from 1% to 10% by weight and even most preferred from 1% to 5% by weight of the composition.

Liquid Carrier

The composition of the invention will also contain a liquid carrier. Suitable liquid carriers are selected from water, organic solvents and mixtures thereof. The liquid carrier employed in the instant compositions is preferably at least primarily water due to its low cost relative availability, safety, and environmental compatibility. The level of water in the liquid carrier is preferably at least 50%, most preferably at least 60%, by weight of the carrier. Mixtures of water and low molecular weight, e.g., <200, organic solvent, e.g., lower alcohol such as ethanol, propanol, isopropanol or butanol are useful as the carrier liquid. Low molecular weight alcohols include monohydric, dihydric (glycol, etc.) trihydric (glycerol, etc.), and higher polyhydric (polyols) alcohols.

The composition may also contain optional components which may be suitable for further improving the aesthetic appearance of the fabrics treated therewith. Suitable optional components include a polyolefin dispersion, a cationic dye fixing agent, additional fabric softener, and mixtures thereof.

Dispersible Polyolefin

A polyolefin dispersion may optionally be used in the composition of the invention in order to provide anti-wrinkles and improved water absorbency benefits to the fabrics. Preferably, the polyolefin is a polyethylene, polypropylene or mixtures thereof. The polyolefin may be at least partially modified to contain various functional groups, such as carboxyl, carbonyl, ester, ether, alkylamide, sulfonic acid or amide groups. More preferably, the polyolefin employed in the present invention is at least partially carboxyl modified or, in other words, oxidized. In particular, oxidized or carboxyl modified polyethylene is preferred in the compositions of the present invention.

For ease of formulation, the polyolefin is preferably introduced as a suspension or an emulsion of polyolefin dispersed by use of an emulsifing agent. The polyolefin suspension or emulsion preferably has from 1 to 50%, more preferably from 10 to 35% by weight, and most preferably from 15 to 30% by weight of polyolefin in the emulsion. The polyolefin preferably has a molecular weight of from 1,000 to 15,000 and more preferably from 4,000 to 10,000.

When an emulsion is employed, the emulsifier may be any suitable emulsification or suspending agent. Preferably, the emulsifier is a cationic, nonionic, zwitterionic or anionic surfactant or mixtures thereof. Most preferably, any suitable cationic, nonionic or anionic surfactant may be employed as the emulsifier. Preferred emulsifiers are cationic surfactants such as the fatty amine surfactants and in particular the ethoxylated fatty amine surfactants. In particular, the cationic surfactants are preferred as emulsifiers in the present invention. The polyolefin is dispersed with the emulsifier or suspending agent in a ratio of emulsifier to polyolefin of from 1:10 to 3:1. Preferably, the emulsion includes from 0.1 to 50%, more preferably from 1 to 20% and most preferably from 2.5 to 10% by weight of emulsifier in the polyolefin emulsion. Polyethylene emulsions and suspensions suitable for use in the present invention are available under the tradename VELUSTROL from HOECHST Aktiengesellschaft of Frankfurt am Main, Germany. In particular, the polyethylene emulsions sold under the tradename VELUSTROL PKS, VELUSTROL KPA, or VELUSTROL P-40 may be employed in the compositions of the present invention.

The compositions of the present invention contain from 0.01% to 8% by weight of the dispersible polyolefin. More preferably, the compositions include from 0.1% to 5% by weight and most preferably from 0.1% to 3% by weight of the polyolefin. When the polyolefin is added to the compositions of the present invention as an emulsion or suspension, the emulsion or suspension is added at sufficient enough quantities to provide the above noted levels of dispersible polyolefin in the compositions.

Cationic Dye Fixing Agent

Another optional component suitable for use herein is a cationic dye fixing agent. Cationic dye fixing agents, or "fixatives", are well-known, commercially available materials which are designed to improve the appearance of dyed fabrics by minimizing the loss of dye from fabrics due to washing but which are not fabric softeners. Cationic dye fixatives are based on various quaternized or otherwise cationically charged organic nitrogen compounds. Cationic fixatives are available under various trade names from several suppliers. Representative examples include: CROSCOLOR PMF (July 1981, Code No. 7894) and CROSCOLOR NOFF (January 1988, Code No. 8544) from Crosfield; INDOSOL E-50 (Feb. 27, 1984, Ref. No. 6008.35.84; polyethyleneamine-based) from Sandoz; SANDOFIX TPS, which is also available from Sandoz and is a preferred polycationic fixative for use herein and SANDOFIX SWE (cationic resinous compound), REWIN SRF, REWIN SRF-O and REWIN DWR from CHT-Beitlich GMBH and Tinofix® ECO available from Ciba-Geigy.

Other cationic dye fixing agents are described in "Aftertreatments for improving the fastness of dyes on textile fibres" by Christopher C. Cook (REV. PROG. COLORATION Vol. 12, 1982). Dye fixing agents suitable for use in the present invention are ammonium compounds such as fatty acid-diamine condensates e.g. the hydrochloride, acetate, metosulphate and benzyl hydrochloride of oleyldiethyl aminoethylamide, oleylmethyldiethylenediaminemethosulphate, monostearyl-ethylene diaminotrimethylammonium methosulphate and oxidized products of tertiary amines; derivatives of polymeric alkyldiamines, polyamine-cyanuric chloride condensates and aminated glycerol dichlorohydrins.

A typical amount of dye fixing agent to be employed in the composition of the invention is preferably of from 0.001% to 10% by weight of the composition, preferably from 0.1% to 5% by weight, more preferably of from 0.5% to 5% by weight of the composition.

Additional Fabric Softener

The composition of the invention may also contain additional fabric softener components. These may be selected from non-biodegradable cationic, nonionic, amphoteric or anionic fabric softening material. Disclosure of such materials may be found in U.S. Pat. Nos. 4,327,133; 4,421,792; 4,426,299; 4,460,485; 3,644,203; 4,661,269; 4,439,335; 3,861,870; 4,308,151; 3,886,075; 4,233,164; 4,401,578; 3,974,076; 4,237,016 and EP 472,178.

Non-biodegradable cationic fabric softening components include the water-insoluble quaternary-ammonium fabric softening actives, the most commonly used having been di-long alkyl chain ammonium chloride or methyl sulfate.

Preferred cationic softeners among these include the following:

1) ditallow dimethylammonium chloride (DTDMAC);
2) dihydrogenated tallow dimethylammonium chloride;
3) dihydrogenated tallow dimethylammonium methylsulfate;
4) distearyl dimethylammonium chloride;
5) dioleyl dimethylammonium chloride;
6) dipalmityl hydroxyethyl methylammonium chloride;
7) stearyl benzyl dimethylammonium chloride;
8) tallow trimethylammonium chloride;
9) hydrogenated tallow trimethylammonium chloride;
10) $C_{12-14}$ alkyl hydroxyethyl dimethylammonium chloride;
11) $C_{12-18}$ alkyl dihydroxyethyl methylammonium chloride;
12) di(stearoyloxyethyl)dimethylammonium chloride (DSOEDMAC);
13) di(tallowoyloxyethyl)dimethylammonium chloride;
14) ditallow imidazolinium methylsulfate;
15) 1-(2-tallowylamidoethyl)-2-tallowyl imidazolinium methylsulfate.

Nonionic fabric softener materials have an HLB of from about 2 to about 9, more typically from about 3 to about 7. Such nonionic fabric softener materials tend to be readily dispersed either by themselves, or when combined with other materials such as single-long-chain alkyl cationic surfactant described in detail hereinafter. Dispersibility can be improved by using more single-long-chain alkyl cationic surfactant, mixture with other materials as set forth hereinafter, use of hotter water, and/or more agitation. In general, the materials selected should be relatively crystalline, higher melting, (e.g. >40° C.) and relatively water-insoluble.

Preferred nonionic softeners are fatty acid partial esters of polyhydric alcohols, or anhydrides thereof, wherein the alcohol, or anhydride, contains from 2 to 18, preferably from 2 to 8, carbon atoms, and each fatty acid moiety contains from 12 to 30, preferably from 16 to 20, carbon atoms. Typically, such softeners contain from 1 to 3, preferably 2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan. Sorbitan esters and polyglycerol monostearate are particularly preferred.

The fatty acid portion of the ester is normally derived from fatty acids having from 12 to 30, preferably from 16 to 20, carbon atoms, typical examples of said fatty acids being lauric acid, myristic acid, palmitic acid, stearic acid and behenic acid.

Highly preferred optional nonionic softening agents for use in the present invention are the sorbitan esters, which are esterified dehydration products of sorbitol, and the glycerol esters.

Commercial sorbitan monostearate is a suitable material. Mixtures of sorbitan stearate and sorbitan palmitate having stearate/palmitate weight ratios varying between about 10:1 and about 1:10, and 1,5-sorbitan esters are also useful.

Glycerol and polyglycerol esters, especially glycerol, diglycerol, triglycerol, and polyglycerol mono- and/or di-esters, preferably mono-, are preferred herein (e.g. polyglycerol monostearate with a trade name of Radiasurf 7248).

Useful glycerol and polyglycerol esters include monoesters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc.

The "glycerol esters" also include the polyglycerol, e.g., diglycerol through octaglycerol esters. The polyglycerol polyols are formed by condensing glycerin or epichlorohydrin together to link the glycerol moieties via ether linkages. The mono- and/or diesters of the polyglycerol polyols are preferred, the fatty acyl groups typically being those described hereinbefore for the sorbitan and glycerol esters.

Additional Components

The composition may also optionally contain additional components such as enzymes, surfactant concentration aids, electrolyte concentration aids, stabilisers, such as well-known antioxidants and reductive agents, soil release polymers, emulsifiers, bacteriocides, colorants, perfumes, preservatives, optical brighteners, anti-ionisation agents, antifoam agents and mixtures thereof. These ingredients, especially the minor ingredients, and especially perfume, can be usefully added with, and preferably protected by, "carrier materials" such as zeolites, starch, cyclodextrin, wax, etc.

Enzymes

The composition herein can optionally employ one or more enzymes such as lipases, proteases, cellulase, amylases and peroxidases. A preferred enzyme for use herein is a cellulase enzyme. Indeed, this type of enzyme will further provide a color care benefit to the treated fabric. Cellulases usable herein include both bacterial and fungal types, preferably having a pH optimum between 5 and 9.5. U.S. Pat. No. 4,435,307, Barbesgoard et al, Mar. 6, 1984, discloses suitable fungal cellulases from *Humicola insolens* or Humicola strain DSM1800 or a cellulase 212-producing fungus belonging to the genus Aeromonas, and cellulase extracted from the hepatopancreas of a marine mollusk, *Dolabella Auricula Solander.*

Suitable cellulases are also disclosed in GB-A-2.075.028; GB-A-2.095.275 and DE-OS-2.247.832. CAREZYME® and CELLUZYME® (Novo) are especially useful. Other suitable cellulases are also disclosed in WO 91/17243 to Novo, WO 96/34092, WO 96/34945 and EP-A-0,739,982.

In practical terms for current commercial preparations, typical amounts are up to about 5 mg by weight, more typically 0.01 mg to 3 mg, of active enzyme per gram of the composition. Stated otherwise, the compositions herein will typically comprise from 0.001% to 5%, preferably 0.01%–1% by weight of a commercial enzyme preparation. In the particular cases where activity of the enzyme preparation can be defined otherwise such as with cellulases, corresponding activity units are preferred (e.g. CEVU or cellulase Equivalent Viscosity Units). For instance, the compositions of the present invention can contain cellulase enzymes at a level equivalent to an activity from about 0.5 to 1000 CEVU/gram of composition. Cellulase enzyme preparations used for the purpose of formulating the compositions of this invention typically have an activity comprised between 1,000 and 10,000 CEVU/gram in liquid form, around 1,000 CEVU/gram in solid form.

Surfactant Concentration Aids

Surfactant concentration aids may also optionally be used. When used, said surfactant concentration aid will help achieving the desired finished product viscosity as well as stabilising the finished product upon storage. Surfactant concentration aids are typically selected from single long chain alkyl cationic surfactants, a nonionic ethoxylated surfactant, amine oxides, fatty acids, and mixtures thereof, typically used at a level of from 0 to 15% by weight of the composition.

Single Long Chain Alkyl Cationic Surfactants

Such mono-long-chain-alkyl cationic surfactants useful in the present invention are, preferably, quaternary ammonium salts of the general formula:

$$[R^2N^+R^3]X^-$$

wherein the $R^2$ group is $C_{10}$–$C_{22}$ hydrocarbon group, preferably $C_{12}$–$C_{18}$ alkyl group of the corresponding ester linkage interrupted group with a short alkylene ($C_1$–$C_4$) group between the ester linkage and the N, and having a similar hydrocarbon group, e.g., a fatty acid ester of choline, preferably $C_{12}$–$C_{14}$ (coco) choline ester and/or $C_{16}$–$C_{18}$ tallow choline ester at from 0.1% to 20% by weight of the softener active. Each R is a $C_1$–$C_4$ alkyl or substituted (e.g., hydroxy) alkyl, or hydrogen, preferably methyl, and the counterion $X^-$ is a softener compatible anion, for example, chloride, bromide, methyl sulfate, etc.

Other cationic materials with ring structures such as alkyl imidazoline, imidazolinium, pyridine, and pyridinium salts having a single $C_{12}$–$C_{30}$ alkyl chain can also be used. Very low pH is required to stabilize, e.g., imidazoline ring structures.

Some alkyl imidazolinium salts and their imidazoline precursors useful in the present invention have the general formula:

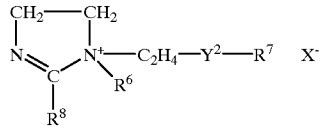

wherein $Y^2$ is —C(O)—O—, —O—(O)C—, —C(O)—N($R^5$)—, or —N($R^5$)—C(O)— in which $R^5$ is hydrogen or a $C_1$–$C_4$ alkyl radical; $R^6$ is a $C_1$–$C_4$ alkyl radical or H (for imidazoline precursors); $R^7$ and $R^8$ are each independently selected from R and $R^2$ as defined hereinbefore for the single-long-chain cationic surfactant with only one being $R^2$.

Some alkyl pyridinium salts useful in the present invention have the general formula:

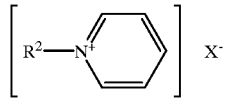

wherein $R^2$ and X– are as defined above. A typical material of this type is cetyl pyridinium chloride.

Nonionic Ethoxylated Surfactant

Suitable nonionic surfactants for use herein include addition products of ethylene oxide and, optionally, propylene oxide, with fatty alcohols, fatty acids and fatty amines.

Suitable compounds are substantially water-soluble surfactants of the general formula:

$$R^2—Y—(C_2H_4O)_z—C_2H_4OH$$

wherein $R^2$ is selected from primary, secondary and branched chain alkyl and/or acyl hydrocarbyl groups; primary, secondary and branched chain alkenyl hydrocarbyl groups; and primary, secondary and branched chain alkyl- and alkenyl-substituted phenolic hydrocarbyl groups; said hydrocarbyl groups having a hydrocarbyl chain length of up to 20, preferably from 10 to 18 carbon atoms.

Y is typically —O—, —C(O)O—, —C(O)N(R)—, or —C(O)N(R)R—, in which $R^2$ and R, when present, have the meanings given hereinbefore, and/or R can be hydrogen, and z is of from 5 to 50, preferably of from 1- to 30.

The nonionic surfactants herein are characterized by an HLB (hydrophilic-lipophilic balance) of from 7 to 20, preferably from 8 to 15.

Examples of particularly suitable nonionic surfactants include

- Straight-Chain, Primary Alcohol Alkoxylates such as tallow alcohol-EO(11), tallow alcohol-EO(18), and tallow alcohol-EO(25);
- Straight-Chain, Secondary Alcohol Alkoxylates such as 2-$C_{16}$EO(11); 2-$C_{20}$EO(11); and 2-$C_{16}$EO(14);
- Alkyl Phenol Alkoxylates, such as p-tridecylphenol EO(11) and p-pentadecylphenol EO(18), as well as
- Olefinic Alkoxylates, and Branched Chain Alkoxylates such as branched chain primary and secondary alcohols which are available from the well-known "OXO" process.

Amine Oxides

Suitable amine oxides include those with one alkyl or hydroxyalkyl moiety of 8 to 28 carbon atoms, preferably from 8 to 16 carbon atoms, and two alkyl moieties selected from alkyl groups and hydroxyalkyl groups with 1 to 3 carbon atoms.

Examples include dimethyloctylamine oxide, diethyldecylamine oxide, bis-(2-hydroxyethyl)dodecylamine oxide, dimethyidodecyl-amine oxide, dipropyltetradecylamine oxide, methyeithylhexadecylamine oxide, dimethyl-2-hydroxyoctadecylamine oxide, and coconut fatty alkyl dimethylamine oxide.

Fatty Acids

Suitable fatty acids include those containing from 12 to 25, preferably from 16 to 20 total carbon atoms, with the fatty moiety containing from 10 to 22, preferably from 15 to 17 (mid cut), carbon atoms.

A preferred surfactant concentration aid for use herein is a nonionic alkoxylated surfactant. When used, such nonionic alkoxylated surfactant will be present in an amount of 0.01% to 10% by weight, preferably from 0.05% to 2% by weight of the composition. Most preferably, for optimum stabilisation of the compositions, the compositions of the invention comprise the amino-functional polymer and the nonionic alkoxylated surfactant in a weight ratio of amino-functional polymer to nonionic alkoxylated surfactant of from 500:1 to 0.5:1, preferably of from 30:1 to 1:1.

Electrolyte Concentration Aids

Inorganic viscosity control agents which can also act like or augment the effect of the surfactant concentration aids, include water-soluble, ionizable salts which can also optionally be incorporated into the compositions of the present invention. Incorporation of these components to the composition must be processed at a very slow rate.

A wide variety of ionizable salts can be used. Examples of suitable salts are the halides of the Group IA and IIA metals of the Periodic Table of the Elements, e.g., calcium chloride, magnesium chloride, sodium chloride, potassium bromide, and lithium chloride. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from 20 to 20,000 parts per million (ppm), preferably from 20 to 11,000 ppm, by weight of the composition.

Alkylene polyammonium salts can be incorporated into the composition to give viscosity control in addition to or in place of the water-soluble, ionizable salts above. In addition, these agents can act as scavengers, forming ion pairs with anionic detergent carried over from the main wash, in the rinse, and on the fabrics, and may improve softness performance. These agents may stabilise the viscosity over a broader range of temperature, especially at low temperatures, compared to the inorganic electrolytes.

Specific examples of alkylene polyammonium salts include l-lysine monohydrochloride and 1,5-diammonium 2-methyl pentane dihydrochloride.

The present invention also encompasses a method for providing color care on treated fabrics which comprises the step of contacting said fabrics in the rinse cycle with an aqueous medium containing a composition as defined hereinbefore. Preferably, the aqueous medium is at a temperature between 2° C. to 40° C., preferably between 5° C. to 25° C. By "color care" is meant that fabrics, previously washed with a detergent composition, and thereafter contacted with an aqueous medium containing a composition comprising a combination of a cationic biodegradable fabric softener and a specific alkoxylated amino-functional polymer, as defined hereinbefore, exhibit a better fabric color appearance compared to fabrics which have not been contacted with said liquid softening composition.

The invention is illustrated in the following non-limiting examples, in which all percentages are on an active weight basis unless otherwise stated.

In the examples, the abbreviated component identifications have the following meanings:

DEQA: Di-(tallowyl-oxy-ethyl) dimethyl ammonium chloride

DTDMAC: Ditallow dimethylammonium chloride

Fatty acid: Stearic acid of IV=0

Electrolyte: Calcium chloride

TAE25: Tallow alcohol ethoxylated with 25 moles of ethylene oxide per mole of alcohol PEG: Polyethylene Glycol 4000

PEI 1800 E1: Ethoxylated polyethylene imine (MW 1800, at 50% active) as synthesised in Synthesis example 1

PEI 1200 E1: Ethoxylated polyethylene imine (MW 1200, at 50% active in water) as synthesised in Synthesis example 3

Carezyme: cellulytic enzyme sold by NOVO Industries A/S

Synthesis Example 1—Preparation of PEI 1800 $E_1$

The ethoxylation is conducted in a 2 gallon stirred stainless steel autoclave equipped for temperature measurement and control, pressure measurement, vacuum and inert gas purging, sampling, and for introduction of ethylene oxide as a liquid. A ~20 lb. net cylinder of ethylene oxide (ARC) is set up to deliver ethylene oxide as a liquid by a pump to the autoclave with the cylinder placed on a scale so that the weight change of the cylinder could be monitored.

A 1800 g portion of polyethyleneimine (PEI) (Nippon Shokubai, Epomin SP-018 having a listed average molecular weight of 1800 equating to about 1.0 mole of polymer and 41.7 moles of nitrogen functions) is added to the autoclave. The autoclave is then sealed and purged of air (by applying vacuum to minus 28" Hg followed by pressurization with nitrogen to 250 psia, then venting to atmospheric pressure). The autoclave contents are heated to 130° C. while applying vacuum. After about one hour, the autoclave is charged with nitrogen to about 250 psia while cooling the autoclave to about 105° C. Ethylene oxide is then added to the autoclave incrementally over time while closely monitoring the autoclave pressure, temperature, and ethylene oxide flow rate. The ethylene oxide pump is turned off and cooling is applied to limit any temperature increase resulting from any reaction exotherm. The temperature is maintained between 100° C. and 110° C. while the total pressure is allowed to gradually increase during the course of the reaction. After a total of 1,800 grams of ethylene oxide. has been charged to the autoclave (roughly equivalent to one mole ethylene oxide per PEI nitrogen function), the temperature is increased to 110° C. and the autoclave is allowed to stir for an additional hour. At this point, vacuum is applied to remove any residual unreacted ethylene oxide.

The reaction mixture is then deodorized by passing about 100 cu. ft. of inert gas (argon or nitrogen) through a gas dispersion frit and through the reaction mixture while agitating and heating the mixture to 130° C.

Note: this procedure can be adapted to the preparation of mono-ethoxylated polyamines by adjusting the relative amounts of ethylene oxide.

Synthesis Example 2—Preparation of PEI 1800 $E_7$

The ethoxylation is conducted in a 2 gallon stirred stainless steel autoclave equipped for temperature measurement and control, pressure measurement, vacuum and inert gas purging, sampling, and for introduction of ethylene oxide as a liquid. A ~20 lb. net cylinder of ethylene oxide (ARC) is set up to deliver ethylene oxide as a liquid by a pump to the autoclave with the cylinder placed on a scale so that the weight change of the cylinder could be monitored.

Step 1

A 750 g portion of polyethyleneimine (PEI) (Nippon Shokubai, Epomin SP-018 having a listed average molecular weight of 1,800 equating to about 0.417 moles of polymer and 17.4 moles of nitrogen functions) is added to the autoclave. The autoclave is then sealed and purged of air (by applying vacuum to minus 28" Hg followed by pressurization with nitrogen to 250 psia, then venting to atmospheric pressure). The autoclave contents are heated to 130° C. while applying vacuum. After about one hour, the autoclave is charged with nitrogen to about 250 psia while cooling the autoclave to about 105° C. Ethylene oxide is then added to the autoclave incrementally over time while closely monitoring the autoclave pressure, temperature, and ethylene oxide flow rate. The ethylene oxide pump is turned off and cooling is applied to limit any temperature increase resulting from any reaction exotherm. The temperature is maintained between 100° C. and 110° C. while the total pressure is allowed to gradually increase during the course of the reaction. After a total of 750 grams of ethylene oxide has been charged to the autoclave (roughly equivalent to one mole ethylene oxide per PEI nitrogen function), the temperature is increased to 110° C. and the autoclave is allowed to stir for an additional hour. At this point, vacuum is applied to remove any residual unreacted ethylene oxide.

Next, vacuum is continuously applied while the autoclave is cooled to about 50° C. while introducing 376 g of a 25% sodium methoxide in methanol solution (1.74 moles, to achieve a 10% catalyst loading based upon PEI nitrogen functions). The methoxide solution is sucked into the autoclave under vacuum and then the autoclave temperature controller setpoint is increased to 130° C. A device is used to monitor the power consumed by the agitator. The agitator power is monitored along with the temperature and pressure. Agitator power and temperature values gradually increase as methanol is removed from the autoclave and the viscosity of the mixture increases and stabilizes in about 1 hour indicating that most of the methanol has been removed. The mixture is further heated and agitated under vacuum for an additional 30 minutes.

Step 2

Vacuum is removed and the autoclave is cooled to 105° C. while it is being charged with nitrogen to 250 psia and then vented to ambient pressure. The autoclave is charged to 200 psia with nitrogen. Ethylene oxide is again added to the autoclave incrementally as before while closely monitoring the autoclave pressure, temperature, and ethylene oxide flow rate while maintaining the temperature between 100° C. and 110° C. and limiting any temperature increases due to reaction exotherm. After the addition of 4,500 g of ethylene oxide (resulting in a total of 7 moles of ethylene oxide per mole of PEI nitrogen function) is achieved over several hours, the temperature is increased to 110° C. and the mixture stirred for an additional hour.

The reaction mixture is then collected in nitrogen purged containers and eventually transferred into a 22 L three neck round bottomed flask equipped with heating and agitation. The strong alkali catalyst is neutralized by adding 167 g methanesulfonic acid (1.74 moles). The reaction mixture is then deodorized by passing about 100 cu. ft. of inert gas (argon or nitrogen) through a gas dispersion frit and through the reaction mixture while agitating and heating the mixture to 130° C.

Note: This procedure can be adapted to the preparation of poly-ethoxylated polyamines by adjusting the relative amounts of ethylene oxide used in Steps 1 and 2.

Synthesis Example 3—Preparation of PEI 1200 $E_1$

Step A)

The ethoxylation is conducted in a 2 gallon stirred stainless steel autoclave equipped for temperature measurement and control, pressure measurement, vacuum and inert gas purging, sampling, and for introduction of ethylene oxide as a liquid. A ~20 lb. net cylinder of ethylene oxide (ARC) is set up to deliver ethylene oxide as a liquid by a pump to the autoclave with the cylinder placed on a scale so that the weight change of the cylinder could be monitored.

A 750 g portion of polyethyleneimine (PEI) (having a listed average molecular weight of 1200 equating to about 0.625 moles of polymer and 17.4 moles of nitrogen functions) is added to the autoclave. The autoclave is then sealed and purged of air (by applying vacuum to minus 28" Hg followed by pressurization with nitrogen to 250 psia, then venting to atmospheric pressure). The autoclave contents are heated to 130° C. while applying vacuum. After about one hour, the autoclave is charged with nitrogen to about 250 psia while cooling the autoclave to about 105° C. Ethylene oxide is then added to the autoclave incrementally over time while closely monitoring the autoclave pressure, temperature, and ethylene oxide flow rate. The ethylene oxide pump is turned off and cooling is applied to limit any temperature increase resulting from any reaction exotherm. The temperature is maintained between 100° C. and 110° C. while the total pressure is allowed to gradually increase during the course of the reaction. After a total of 750 grams of ethylene oxide has been charged to the autoclave (roughly equivalent to one mole ethylene oxide per PEI nitrogen function), the temperature is increased to 110° C. and the autoclave is allowed to stir for an additional hour. At this point, vacuum is applied to remove any residual unreacted ethylene oxide.

Step B)

The reaction mixture is then deodorized by passing about 100 cu. ft. of inert gas (argon or nitrogen) through a gas dispersion frit and through the reaction mixture while agitating and heating the mixture to 130° C.

The final reaction product is cooled slightly and collected in glass containers purged with nitrogen.

In other preparations the neutralization and deodorization is accomplished in the reactor before discharging the product.

If a PEI 1200 $E_7$ is desired, the following step of catalyst addition will be included between Step A and B.

Vacuum is continuously applied while the autoclave is cooled to about 50° C. while introducing 376 g of a 25% sodium methoxide in methanol solution (1.74 moles, to achieve a 10% catalyst loading based upon PEI nitrogen functions). The methoxide solution is sucked into the autoclave under vacuum and then the autoclave temperature controller setpoint is increased to 1300° C. A device is used to monitor the power consumed by the agitator. The agitator power is monitored along with the temperature and pressure. Agitator power and temperature values gradually increase as methanol is removed from the autoclave and the viscosity of the mixture increases and stabilizes in about 1 hour indicating that most of the methanol has been removed. The mixture is further heated and agitated under vacuum for an additional 30 minutes.

Vacuum is removed and the autoclave is cooled to 105° C. while it is being charged with nitrogen to 250 psia and then vented to ambient pressure. The autoclave is charged to 200 psia with nitrogen. Ethylene oxide is again added to the autoclave incrementally as before while closely monitoring the autoclave pressure, temperature, and ethylene oxide flow rate while maintaining the temperature between 100° C. and 110° C. and limiting any temperature increases due to reaction exotherm. After the addition of 4,500 g of ethylene oxide (resulting in a total of 7 moles of ethylene oxide per mole of PEI nitrogen function) is achieved over several hours, the temperature is increased to 110° C. and the mixture stirred for an additional hour.

The reaction mixture is then collected in nitrogen purged containers and eventually transferred into a 22 L three neck round bottomed flask equipped with heating and agitation. The strong alkali catalyst is neutralized by adding 167 g methanesulfonic acid (1.74 moles).

Other preferred examples such as PEI 1200 E15 and PEI 1200 E20 can be prepared by the above method by adjusting the reaction time and the relative amount of ethylene oxide used in the reaction.

EXAMPLE

The following compositions are in accordance with the present invention:

| Component | A | B | C | D | E | F | G |
|---|---|---|---|---|---|---|---|
| DEQA | 2.6 | 2.9 | 18.0 | 19.0 | 19.0 | 19.0 | 19.0 |
| TAE25 | 0.3 | — | — | 0.5 | 0.1 | 1.0 | 1.0 |
| Fatty acid | 0.3 | — | 1.0 | — | — | — | — |
| Hydrochloride acid | 0.02 | 0.02 | 0.02 | 0.02 | 0.02 | 0.02 | 0.02 |
| PEG | — | — | 0.6 | 0.6 | 0.6 | 0.6 | 0.6 |
| Perfume | 1.0 | 1.0 | 1.0 | 1.0 | 1.0 | 1.0 | 1.0 |
| Silicone antifoam | 0.01 | 0.01 | 0.01 | 0.01 | 0.01 | 0.01 | 0.01 |
| PEI 1800 E1 | 3.0 | — | — | 3.0 | — | 1.0 | — |
| PEI 1200 E1 | — | 3.0 | 3.0 | — | 3.0 | — | 1.0 |
| Electrolyte (ppm) | — | — | 600 | 600 | 1200 | 600 | 600 |
| Dye (ppm) | 10 | 10 | 50 | 50 | 50 | 50 | 50 |
| Carezyme CEVU/g of composition | — | — | — | — | 50 | — | — |
| Water and minors to balance to 100 | | | | | | | |

What is claimed is:

1. A liquid fabric softening composition comprising a cationic biodegradable fabric softener, a dispersible polyolefin and an alkoxylated amino-functional polymer, wherein said alkoxylated amino-functional polymer is a non-oxidised, non-quaternized alkoxylated polyalkylene imine and said biodegradable cationic fabric softener is selected from the group consisting of quaternary ammonium compounds and amine precursors having the formula (I) or (II), below:

(I)

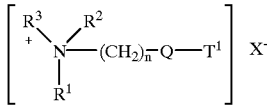

or

-continued (II)

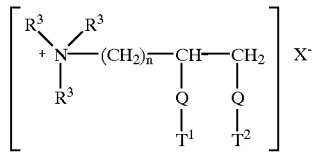

wherein

Q is selected from —O—C(O)—, —C(O)—O—, —O—C(O)—O—, $NR^4$—C(O)—, —C(O)—$NR^4$;

$R^1$ is $(CH_2)_nQ—T^2$ or $T^3$;

$R^2$ is $(CH_2)_m—Q—T^4$ or $T^5$ or $R^3$;

$R^3$ is $C_1$–$C_4$ alkyl or $C_1$–$C_4$hydroxyalkyl or H;

$R^4$ is H or $C_1$–$C_4$ alkyl or $C_1$–$C_4$ hydroxyalkyl;

$T^1$, $T^2$, $T^3$, $T^4$, $T^5$ are independently $C_{11}$–$C_{22}$ alkyl or alkenyl;

n and m are integers from about 1 to about 4; and

X– is a softener-compatible anion; and with the proviso that when said biodegradable cationic fabric softener is di(2-tallowylamido)ethyl methyl ammonium chloride), said amino-functional polymer is not an ethoxylated polyethyleneimine having a weight ratio of polyethyleneimine to ethylene oxide of 1.3:1 and a molecular weight of 60,000.

2. A composition according to claim 1, wherein said alkoxylated amino-functional polymer is present in an amount of at least about 0.01% by weight of the composition.

3. A composition according to claim 2, wherein said alkoxylated amino-functional polymer is present in an amount of at least about 1% by weight of the composition.

4. A composition according to claim 1 wherein said alkoxylated amino-functional functional polymer has a molecular weight between about 200 and about $10^6$.

5. A composition according to claim 4 wherein said alkoxylated amino-functional functional polymer has a molecular weight between about 600 and about 20,000.

6. A composition according to claim 4 wherein said alkoxylated amino-functional functional polymer has a molecular weight between about 1,000 and about 10,000.

7. A composition according to claim 1, wherein said amino-functional polymers of the present invention are selected from the group consisting of:

a)-linear or non-cyclic polyamines having a backbone of the formula:

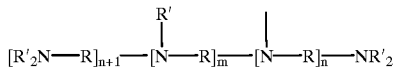

b)-cyclic polyamines having a backbone of the formula:

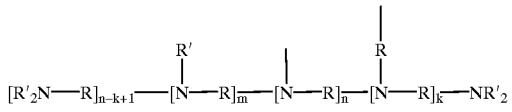

and mixtures thereof; and wherein in at least one of the polyamine backbone NR' units, R' is —$(R^1O)_xB$, and wherein the backbone linking R units are selected from the group consisting of $C_2$–$C_{12}$ alkylene, $C_4$–$C_{12}$ alkenylene, $C_3$–$C_{12}$ hydroxyalkylene, $C_4$–$C_{12}$ dihydroxy-alkylene, $C_8$–$C_{12}$ dialkylarylene, —$(R^1O)_xR^1$—, —$(R^1O)_xR^5(OR^1)_x$—, —$(CH_2CH(OR^2)CH_2O)_z(R^1O)_yR^1(OCH_2CH(OR^2)CH_2)_w$—, —$C(O)(R^4)_rC(O)$—, —$CH_2CH(OR^2)CH_2$—, and mixtures thereof; wherein $R^1$ is selected from the group consisting of $C_2$–$C_6$ alkylene and mixtures thereof; $R^2$ is selected from the group consisting of hydrogen, —$(R^1O)_xB$, and mixtures thereof; $R^4$ is selected from the group consisting of $C_1$–$C_{12}$ alkylene, $C_4$–$C_{12}$ alkenylene, $C_8$–$C_{12}$ arylalkylene, $C_6$–$C_{10}$ arylene, and mixtures thereof; $R^5$ is selected from the group consisting of $C_1$–$C_{12}$ alkylene, $C_3$–$C_{12}$ hydroxyalkylene, $C_4$–$C_{12}$ dihydroxy-alkylene, $C_8$–$C_{12}$ dialkylarylene, —C(O)—, —$C(O)NHR^6NHC(O)$—, —$R^1(OR^1)$—, —$C(O)(R^4)_rC(O)$—, —$CH_2CH(OH)CH_2$—, —$CH_2CH(OH)CH_2O(R^1O)_yR^1OCH_2CH(OH)CH_2$—, and mixtures thereof; $R^6$ is selected from the group consisting of $C_2$–$C_{12}$ alkylene or $C_6$–$C_{12}$ arylene; R' units are selected from the group consisting of hydrogen, $C_1$–$C_{22}$ alkyl, $C_3$–$C_{22}$ alkenyl, $C_7$–$C_{22}$ arylalkyl, $C_2$–$C_{22}$ hydroxyalkyl, —$(CH_2)_pCO_2M$, —$(CH_2)_qSO_3M$, —$CH(CH_2CO_2M)CO_2M$, —$(CH_2)_pPO_3M$, —$(R^1O)_xB$, —$C(O)R^3$, and mixtures thereof; B is selected from the group consisting of hydrogen, $C_1$–$C_6$ alkyl, —$(CH_2)_qSO_3M$, —$(CH_2)_pCO_2M$, —$(CH_2)_q(CHSO_3M)CH_2SO_3M$, —$(CH_2)_q$—$(CHSO_2M)CH_2SO_3M$, —$(CH_2)_pPO_3M$, —$PO_3M$, and mixtures thereof; $R^3$ is selected from the group consisting of $C_1$–$C_{18}$ alkyl, $C_7$–$C_{12}$ arylalkyl, $C_7$–$C_{12}$ alkyl substituted aryl, $C_6$–$C_{12}$ aryl, and mixtures thereof; M is hydrogen or a water-soluble cation in sufficient amount to satisfy charge balance; X is a water-soluble anion; m has the value from about 2 to about 700; n has the value from 0 to about 350; p has the value from about 1 to about 6, q has the value from 0 to about 6; r has the value of 0 or 1; w has the value 0 or 1; x has the value from about 1 to about 100; y has the value from 0 to about 100; z has the value 0 or 1.

8. A composition according to claim 7, wherein R units are selected from the group consisting of $C_2$–$C_{12}$ alkylene, $C_3$–$C_{12}$ hydroxyalkylene, $C_4$–$C_{12}$ dihydroxyalkylene, $C_8$–$C_{12}$ dialkylarylene, —$(R^1O)_xR^1$—, —$(R^1O)_xR^5(OR^1)_x$—, —$(CH_2CH(OH)CH_2O)_z(R^1O)_yR^1$—$(OCH_2CH(OH)CH_2)_w$—, —$CH_2CH(OR^2)CH_2$—, and mixtures thereof.

9. A composition according to claim 7, wherein $R^1$ is selected from the group consisting of $C_2$–$C_6$ alkylene, $C_3$–$C_6$ alkyl substituted alkylene, and mixtures thereof.

10. A composition according to claim 7, wherein $R^3$ is selected from the group consisting of $C_1$–$C_6$ alkyl and mixtures thereof.

11. A composition according to claim 7, wherein $R^4$ is selected from the group consisting of $C_2$–$C_{12}$ alkylene, $C_8$–$C_{12}$ arylalkylene, and mixtures thereof.

12. A composition according to claim 7, wherein $R^5$ is selected from the group consisting of ethylene, —C(O)—, —$C(O)NHR^6NHC(O)$—, —$R^1(OR^1)_y$—, —$(CH_2CH(OH)CH_2O)_z(R^1O)_yR^1$—$(OCH_2CH(OH)CH_2)_w$—, —$CH_2CH(OH)CH_2$—, and mixtures thereof.

13. A composition according to claim 7, wherein R' units are selected from the group consisting of hydrogen, $C_3$–$C_{22}$ hydroxyalkyl, benzyl, $C_1$–$C_{22}$ alkyl, —$(R^1O)_xB$, —$C(O)R^3$, —$(CH_2)_pCO_2^-M^+$, —$(CH_2)_qSO_3^-M^+$, —$CH(CH_2CO_2M)CO_2M$ and mixtures thereof.

14. A composition according to claim 7, wherein B units are selected from the group consisting of hydrogen, —$(CH_2)_qSO_3M$, —$(CH_2)_q(CHSO_3M)CH_2SO_3M$, —$(CH_2)_q(CHSO_2M)$—$CH_2SO_3M$, and mixtures thereof.

15. A composition according to claim 13, wherein x has a value lying in the range of from about 1 to about 20.

16. A composition according to claim 15, wherein x has a value lying in the range of from about 1 to about 10.

17. A composition according to claim 1, wherein said composition further comprises a surfactant concentration aid.

18. A composition according to claim 17, wherein said composition further comprises a nonionic ethoxylated surfactant.

19. A composition according to claim 1, wherein said composition further comprises an enzyme.

20. A composition according to claim 19, wherein said enzyme is cellulase.

21. A method for providing color care on treated fabrics which comprises the step of contacting said fabrics in the rinse cycle with an aqueous medium containing a composition as defined in claim 1.

22. A method according to claim 21, wherein said aqueous medium is at a temperature between about 2° C. to about 40° C.

23. A method according to claim 22, wherein said aqueous medium is at a temperature between about 5° C. to about 25° C.

* * * * *